US010553090B1

(12) United States Patent
Tolliver et al.

(10) Patent No.: US 10,553,090 B1
(45) Date of Patent: Feb. 4, 2020

(54) ROOM BREACH DIGITAL SENSOR ALERT DEVICE

(71) Applicant: The United States of America as represented by the Secretary of the Navy, San Diego, CA (US)

(72) Inventors: Laura C. Tolliver, Mt. Pleasant, SC (US); Peyton B. Cavaroc, Charleston, SC (US); Kevin P. Votapka, Charleston, SC (US); Robert R. Regal, Charleston, SC (US); Lucas D. Powell, Charleston, SC (US); Hunter J. Smith, Charleston, SC (US)

(73) Assignee: United States of America as represented by Secretary of the Navy, Washington, DC (US)

( * ) Notice: Subject to any disclaimer, the term of this patent is extended or adjusted under 35 U.S.C. 154(b) by 0 days.

(21) Appl. No.: 16/110,774

(22) Filed: Aug. 23, 2018

(51) Int. Cl.

| | |
|---|---|
| ***G08B 13/18*** | (2006.01) |
| ***G08B 13/19*** | (2006.01) |
| ***G08B 25/10*** | (2006.01) |
| ***G08B 13/196*** | (2006.01) |

(52) U.S. Cl.
CPC ..... *G08B 13/19* (2013.01); *G08B 13/19602* (2013.01); *G08B 25/10* (2013.01)

(58) Field of Classification Search
CPC ... G08B 13/19; G08B 13/19602; G08B 25/10
USPC ..... 340/567
See application file for complete search history.

(56) References Cited

U.S. PATENT DOCUMENTS

2013/0240235 A1* 9/2013 Higashihama ..... H01H 9/02 174/53

* cited by examiner

*Primary Examiner* — Tanmay K Shah
(74) *Attorney, Agent, or Firm* — Naval Information Warfare Center, Atlantic; Kyle Eppele; Young Fei

(57) ABSTRACT

A device for signaling including a top member adjacent to a bottom member, a button adjacent to the top member, a sensor adjacent to the top member, a radio adjacent to the top member, a microprocessor board adjacent to the radio, a battery adjacent to the microprocessor board, and a switch adjacent to the bottom member. A button slot and sensor hole formed through the top member. The button is received in the button slot and the sensor in the sensor slot. The microprocessor board further comprises a light emitting diode. The bottom member has a bottom recess and a switch slot. The switch is received in the switch slot. The top member has a sensor recess and a screw hole. The sensor is retained in the sensor recess. The bottom member has a screw recess. The radio, microprocessor board, and battery are slidably received in the bottom slot.

17 Claims, 6 Drawing Sheets

Inductor 1 uH
P$1
P$2
L1
VIN
VINA
EN
PS/SYNC
GND
L2
VOUT
FB
PGND
P$1
PP
C8
0.1u
C1
10u
C5
10u
C6
10u
C7
10u
+3V3
TP2
TP6
TP7
GNDA
Radio
VCC
DOUT
DIN
DIO12
RESET
DIO10
DIO11
RESERVE
SLEEP_RQ
GND
AD0
AD1
AD2
AD3
RTS/DIO6
ASSOCIATE/D5
VREF/GND
DIO9
CTS/DIO7
DIO4
TP5
C10
0.1u
R7
10k
Microcontroller
VDD
RA5
RA4
MCLR
RC5
RC4
RC3
RC6
RC7
TX
VSS
RA0
RA1
VSUB3V3
RC0/DAT
INT/CLK
RC2
RB4
RX
RB6
C2
0.1u
R6
10k
R5
10k
R3
R2
R4
LED1
LED3
LED2G$1
TP8
RED
GREEN
BLUE

ROOM BREACH DIGITAL SENSOR ALERT DEVICE

FEDERALLY SPONSORED RESEARCH AND DEVELOPMENT

The Room Breach Digital Sensor Alert Device is assigned to the United States Government and is available for licensing and commercial purposes. Licensing and technical inquiries may be directed to the Office of Research and Technical Applications, Space and Naval Warfare Systems Center Atlantic (Code 70F00), North Charleston, S.C., 29419 via telephone at (843) 218-3495 or via email at ssc_lant_t2@navy.mil. Reference Navy Case 108458.

CROSS-REFERENCE TO RELATED APPLICATION

This application claims the benefit of U.S. Provisional Patent Application Ser. No. 62/651,999 filed Apr. 3, 2018.

BACKGROUND OF THE INVENTION

1. Field of the Invention

This invention relates to an alert device, and in particular to an alert device for detecting and warning a user when another person has entered a room.

2. Description of the Related Art

When military or law enforcement personnel determine that a room has been cleared of hostile persons, the conventional prior art technique used to alert other personnel that the room has been cleared is to leave a chemical light stick of a predetermined color behind. Conventionally, the military or law enforcement personnel will also leave a member behind in order to ensure that additional hostile persons do not reenter the cleared room.

SUMMARY OF THE INVENTION

The present invention is a device for signaling. The device includes a top member adjacent to a bottom member, a button adjacent to the top member, a sensor adjacent to the top member, a radio adjacent to the top member, a microprocessor board adjacent to the radio, a battery adjacent to the microprocessor board, and a switch adjacent to the bottom member.

An embodiment of the invention also includes a button slot and sensor hole formed through the top member. The button is received in the button slot and the sensor is received in the sensor slot. The microprocessor board further comprises a light emitting diode. The bottom member has a bottom recess and a switch slot. The switch is received in the switch slot. The top member has a sensor recess and a screw hole. The sensor is retained in the sensor recess. The bottom member has a screw recess. The radio, microprocessor board, and battery are slidably received in the bottom slot.

BRIEF DESCRIPTION OF THE DRAWINGS

Throughout the several views, like elements are referenced using like elements. The elements in the figures are not drawn to scale, and some dimension may be exaggerated for clarity.

DETAILED DESCRIPTION OF THE INVENTION

Conventionally, when military and law enforcement personnel clear a room, a physical marker such as a chemical light stick is used to mark the room as having been cleared. Additionally, a member of the team will be left behind to guard the cleared room against reentry by hostile persons. The present invention is a device 100 which allows military and law enforcement personnel to indicate both that a room has been cleared and indicate when a hostile person reenters that cleared room. The present invention serves as a force multiplier, allowing the military or law enforcement team to not leave a member behind in order to ensure that a previously cleared room is reentered. The present invention indicates via a light emitting diode 114 the status of the room, senses at a sensor 107 when persons enter the room, then alerts the military or law enforcement team using a radio 112 when the sensor 107 detects a person.

Figure 1:
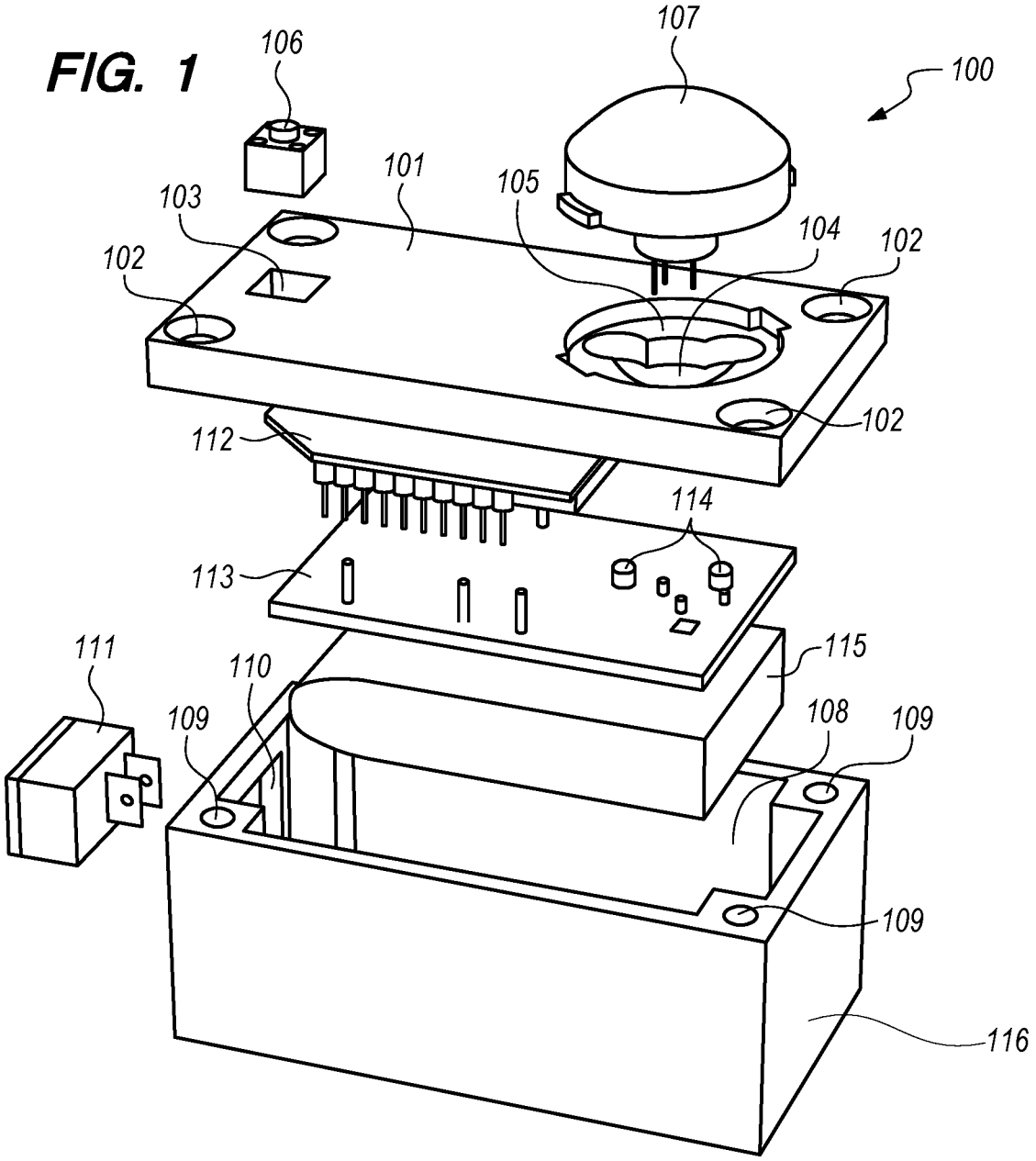
FIG. 1 shows an exploded view of the components of an embodiment of the present invention.

FIG. 1 depicts the components of the device 100 in an exploded view. The device 100 comprises a top member 101 and bottom member 116. The top member has a plurality of screw holes 102, a button slot 103, a sensor hole 104, and a sensor recess 105. A button 106 is received in the button slot 103, while a sensor 107 is received in the sensor hole 104 and sensor recess 105. A radio 112 is attached to top member. A microprocessor board 113 is electrically attached to the radio 112 and sensor 107. The button 106 is electrically attached to the microprocessor board 113. The battery 115 and switch 111 are also electrically attached to the microprocessor board 113. Additionally, the microprocessor board has a plurality of light emitting diodes 114. The bottom member 116 has a bottom recess 108 and a plurality of screw recesses 109.

Figure 2:
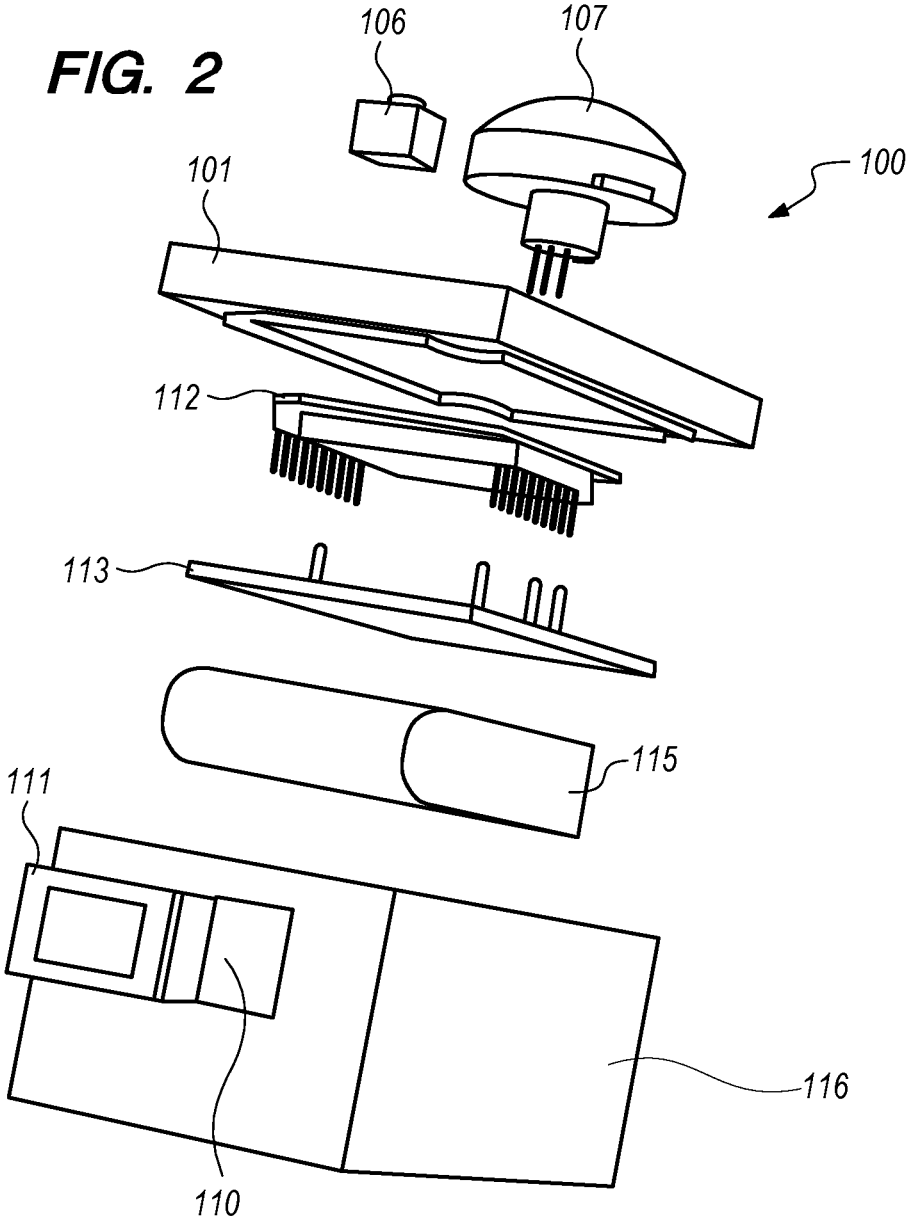
FIG. 2 shows an exploded view of the components of an embodiment of the present invention.

FIG. 2 depicts the underside of the components of the device 100 in an exploded view. FIG. 2 depicts the connections between the radio 112 and the microprocessor board 113 in greater detail. FIG. 2 also depicts the connections between the microprocessor board 113 and the top member 101 in greater detail. Additionally, FIG. 2 clearly shows the switch slot.

Figure 3:
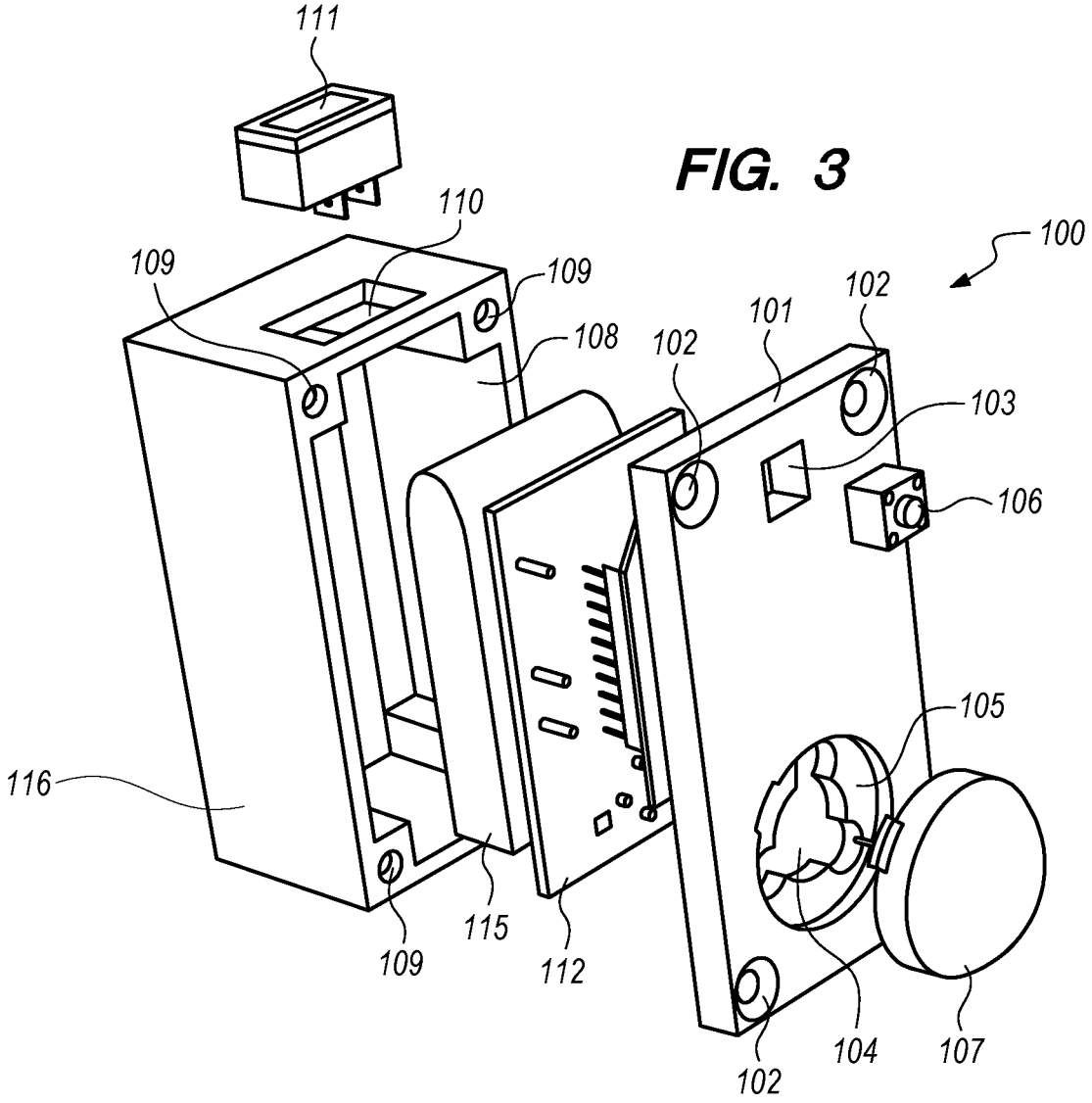
FIG. 3 shows a top perspective view of an embodiment of the present invention.

FIG. 3 is a perspective view depicting the device 100 when it is fully assembled. FIG. 3 clearly depicts the relation between the sensor 107 and the top member 101 when the sensor 107 is received in the sensor hole 104 and sensor recess 105. FIG. 3 also clearly depicts the relation between the button 106 and the top member 101 when the button is received in the button slot 103, as well as the relation between the switch 111 and the bottom member 116 when the switch 111 is received in the switch slot 110. Additionally, FIG. 3 depicts the relationship between the top member 101 and the bottom member 116, including the alignment of the screw holes 102 with the screw recesses 109 when the top member 101 is attached to the bottom member 116.

Figure 4:
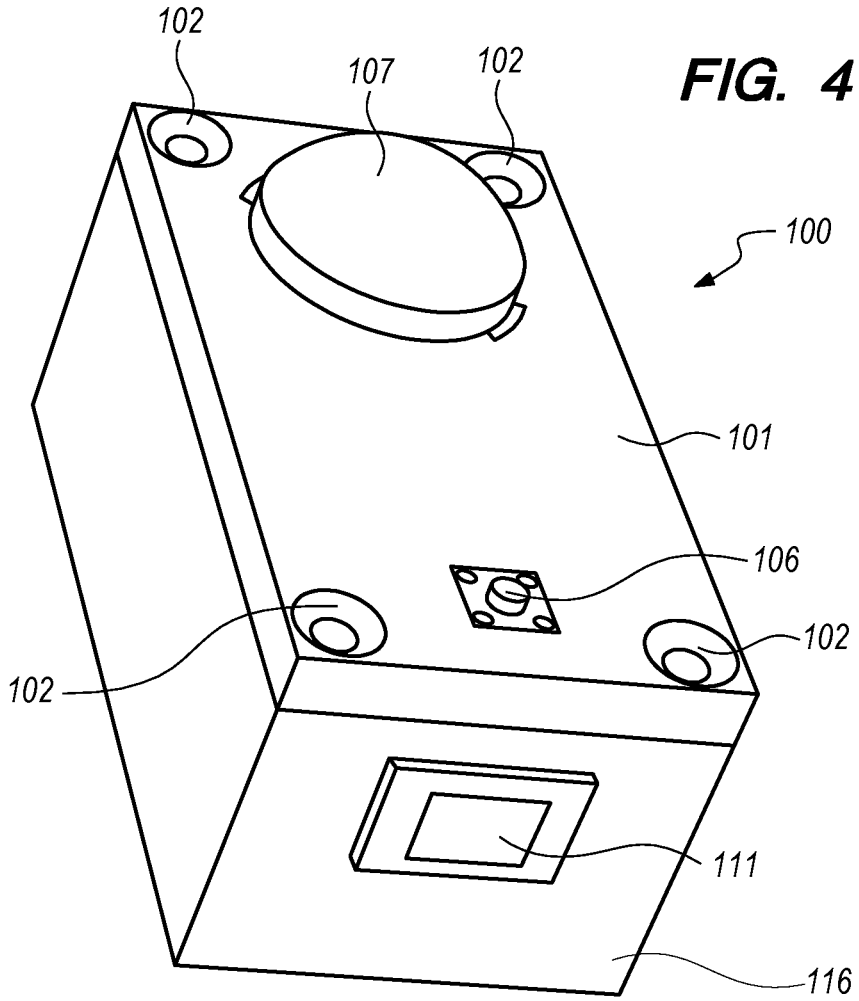
FIG. 4 shows an exploded view of the components of an embodiment of the present invention.

FIG. 4 is an exploded view clearly depicting how the battery 115, the microprocessor board 113, and the radio 112 are received in the bottom recess 108. FIG. 4 also clearly shows the relationship between the switch 111 and the switch slot 110.

Figure 5:
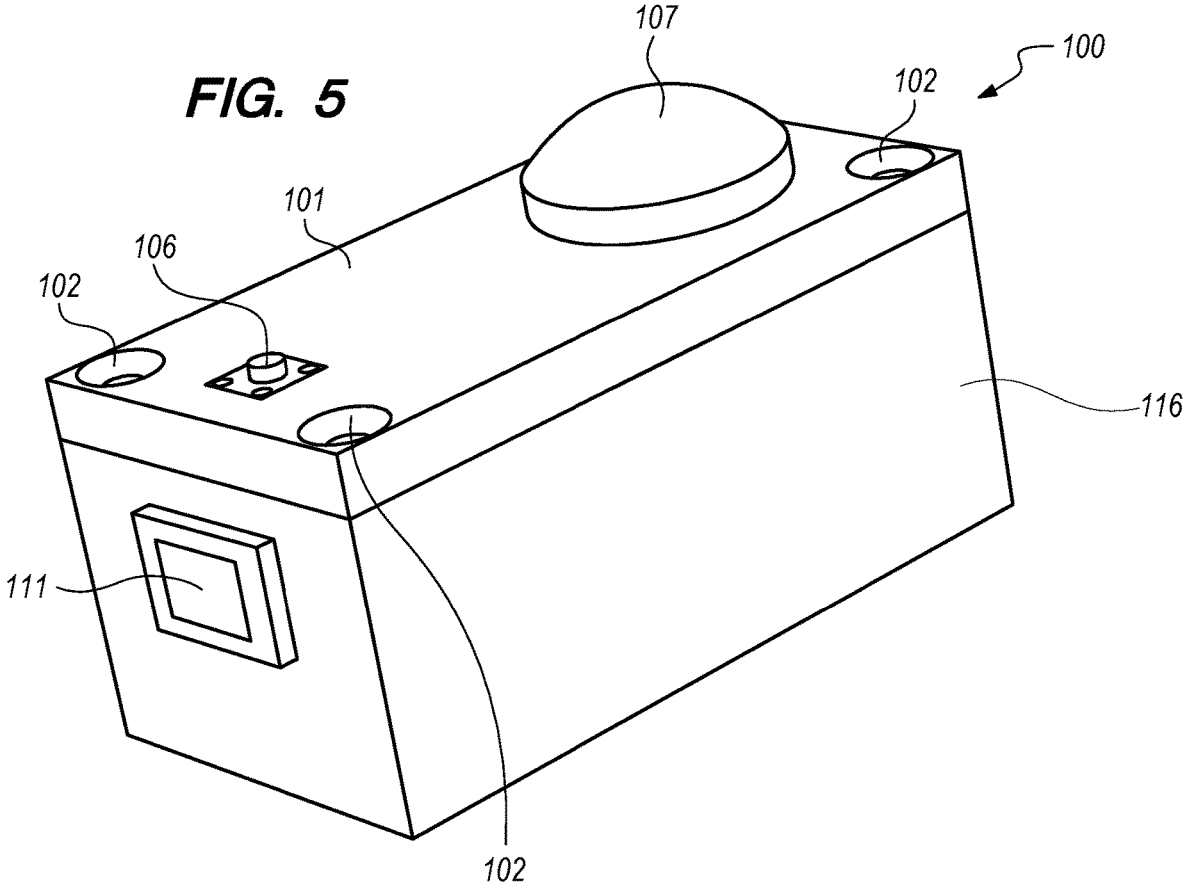
FIG. 5 shows a right perspective view of an embodiment of the present invention.

FIG. 5 is a perspective view depicting the fully assembled device 100 from the side.

Figures 6, 6A:
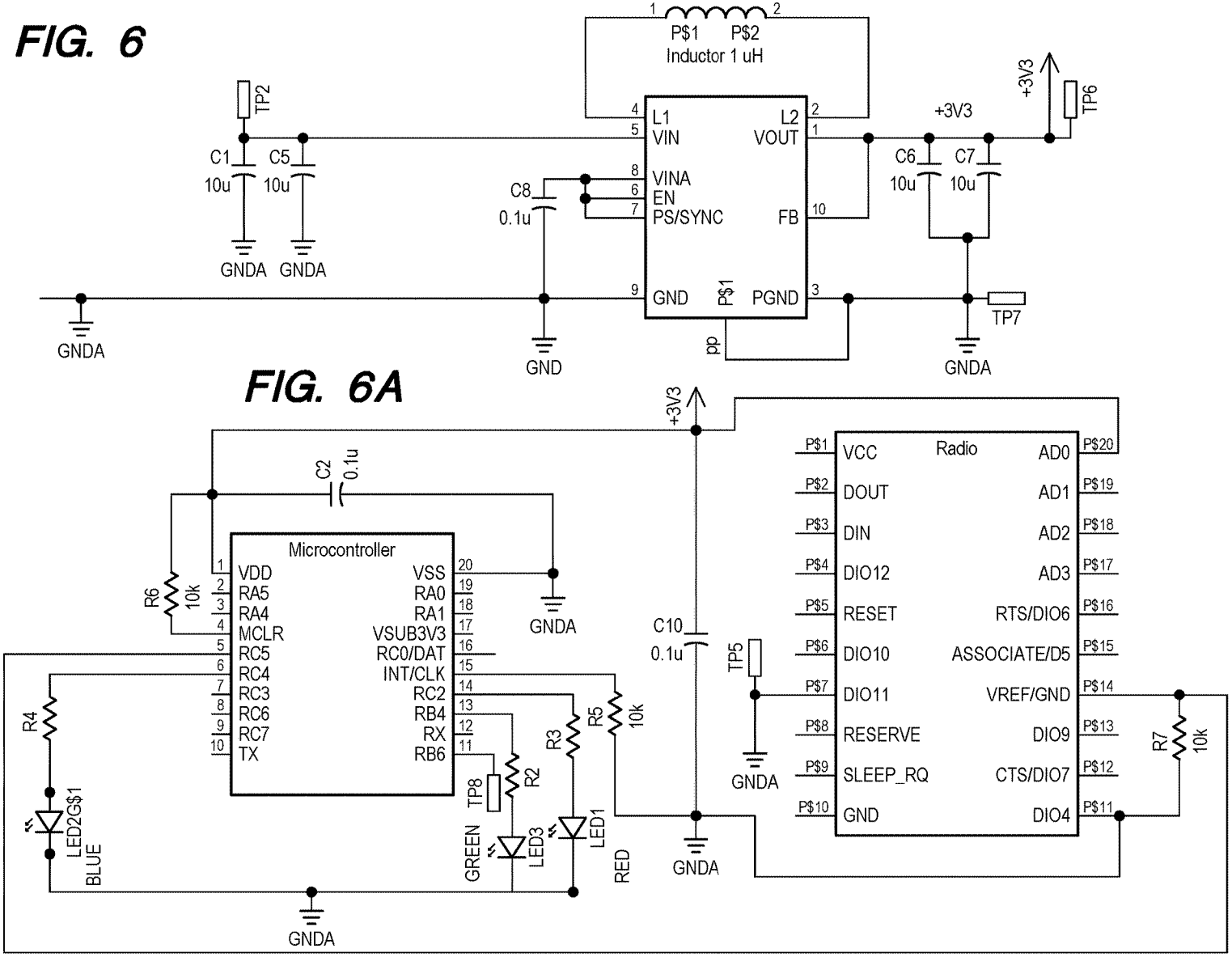
FIG. 6 and FIG. 6A depict wiring diagrams showing an embodiment of the present invention.

FIG. 6 and FIG. 6A are wiring diagrams depicting how the radio 112 and light emitting diodes 114 are electrically connected with the microcontroller on the microprocessor board 113.

In one embodiment of the invention, the light emitting diodes 114 may be a red light emitting diode, a green light emitting diode, and a blue light emitting diode. This embodiment is depicted in FIG. 6. Each color of the light emitting diode 114 may be used to indicate a different room state. This can serve as a versatile facsimile of or substitute for the conventionally used differently colored conventional light sticks that military and police personnel use when clearing rooms.

In one embodiment of the invention, each device 100 acts as an alert mechanism, alerting the user when an unknown or hostile person enters a room. The sensor 107 is a low power passive infrared motion sensor. When the sensor 107 recognizes that a previously secured room or space has been entered, a signal is sent from the sensor 107 to the microcontroller or microprocessor on the microprocessor board 113. A signal is then sent from the microcontroller or microprocessor on the microprocessor board 113 to the radio 112, which can broadcast the message to a system receiver. This receiver can be worn by a single military or police member or multiple members. The output can be displayed as an alert on a display screen or output as an audible alert. Additionally, the receiver can output messages over a serial connection to a computer system, which can then be broadcast to others in order to contribute to a common operating picture. The devices 100 and receivers can interface with one another to form a mesh network and communicate via radio frequency and wired networks to locations around the world.

The device 100 is cost effective, has a small size and light weight, and is easily deployed. Additional features can be integrated such as the ability to take still photographs and videos. The electronics in the device 100 are specifically chosen to consume little power. The device 100 may be left behind as a single use disposable or retrieved for reuse.

From the above description of the present invention, it is manifest that various techniques may be used for implementing its concepts without departing from the scope of the claims. The described embodiments are to be considered in all respects as illustrative and not restrictive. The device disclosed herein may be practiced in the absence of any element that is not specifically claimed and/or disclosed herein. It should also be understood that the present invention is not limited to the particular embodiments described herein, but is capable of being practiced in many embodiments without departure from the scope of the claims.

What is claimed is:

1. A device for signaling room status comprising:

a sensor for detecting movement;

at least one light emitter for locally signaling a current room state, which is one of a plurality of room states including a secured state and a breached state;

a radio for remotely signaling the current room state; and a microprocessor configured to set the current room state, including changing the current room state from the secured state to the breached state in response to the sensor detecting movement.

2. The device of claim 1, wherein the microprocessor is configured to set the current room state to the secured state in response to a user of the device ascertaining a particular room is cleared, and the device is adapted to be subsequently disposed at an entrance of the particular room while the at least one light emitter and the radio continue to signal the current room state is the secured state until the microprocessor changes the current room state to the breached state in response to the sensor detecting movement.

3. The device of claim 2, further comprising a microprocessor board, wherein the microprocessor board comprises the microprocessor and the at least one light emitter comprising a light emitting diode.

4. The device of claim 3, further comprising a top member and a bottom member that are arranged to form a cavity therebetween, wherein the radio, the microprocessor board, and a battery are slidably received in the cavity.

5. The device of claim 4, wherein the sensor is an infrared sensor, wherein the infrared sensor is configured to send a signal to the microprocessor board upon detecting movement of a person breaching the entrance of the particular room.

6. The device of claim 5, wherein the microprocessor board is configured to remotely transmit via the radio a signal indicating the current room state is the breached state upon receiving the signal from the infrared sensor.

7. The device of claim 6, wherein the microprocessor board is further configured to provide power to the light emitting diode upon receiving the signal from the infrared sensor, the powered light emitting diode indicating the current room state is the breached state.

8. The device of claim 7, wherein the at least one light emitter includes a red light emitting diode, a green light emitting diode, and a blue light emitting diode for locally signaling a respective one of the plurality of room states.

9. The device of claim 8, wherein the top member has a sensor hole formed therethrough and the sensor is received in the sensor hole.

10. The device of claim 9, further comprising a button for the user of the device indicating the particular room is cleared, wherein the top member has a button slot formed therethrough and the button is received in the button slot.

11. The device of claim 10, further comprising a switch for controlling delivery of power from the battery to the microprocessor board and the radio, wherein the bottom member has a switch slot formed therethrough, and the switch is received in the switch slot.

12. The device of claim 11, wherein the bottom member has a bottom recess formed thereon, and the bottom recess forms the cavity.

13. The device of claim 12, further comprising at least one screw, wherein the top member has a screw hole formed therethrough, and the bottom member has a screw recess formed thereon, the screw attaching the top member to the bottom member via the screw hole and the screw recess.

14. The device of claim 13, wherein the device is adapted to remotely signal the current room state to a receiver carried by the user, such that the receiver provides an alert warning the user when the current room state becomes the breached state upon the infrared sensor detecting movement of the person breaching the entrance of the particular room.

15. A system for signaling room status comprising:

the device of claim 14; and the receiver that provides the alert on a display screen or as an audible alert.

16. The device of claim 2, wherein the device is adapted to remotely signal the current room state to a receiver carried by the user, such that the receiver provides an alert warning the user when the current room state becomes the breached state upon the sensor detecting movement of a person breaching the entrance of the particular room.

17. A system for signaling room status comprising:

the device of claim 16; and the receiver that provides the alert on a display screen or as an audible alert.

* * * * *